US009341978B2

(12) United States Patent
Sato

(10) Patent No.: US 9,341,978 B2
(45) Date of Patent: May 17, 2016

(54) IMAGE FORMING APPARATUS AND EXPOSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yoji Sato, Izunokuni Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/598,680

(22) Filed: Jan. 16, 2015

(65) Prior Publication Data

US 2015/0205223 A1 Jul. 23, 2015

(30) Foreign Application Priority Data

Jan. 17, 2014 (JP) ..... 2014-006607

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/5041
See application file for complete search history.

(56) References Cited

U.S. PATENT DOCUMENTS

2013/0302052 A1* 11/2013 Iwata ..... G03G 13/04 399/49
2014/0072315 A1* 3/2014 Ohmiya ..... G03G 15/0131 399/49

FOREIGN PATENT DOCUMENTS

JP 2006231836 A 9/2006

* cited by examiner

*Primary Examiner* — Sarah Al Hashimi
(74) *Attorney, Agent, or Firm* — Patterson & Sheridan, LLP

(57) ABSTRACT

An image forming apparatus includes a light scan head having a plurality of LED elements disposed along a main-scanning direction of a photoreceptor drum and configured to expose the photoreceptor drum with light, a developing device disposed to face the photoreceptor drum in the main-scanning direction and including a development roller configured to supply a developer to the photoreceptor drum, and a non-uniform density correction unit configured to control an intensity of light emitted from the plurality of LED elements of the light scan head based on correction data that corresponds to a tendency pattern of an expected non-uniform image density so as to correct the non-uniform density of an image that is to be formed on a recording medium.

12 Claims, 9 Drawing Sheets

IMAGE FORMING APPARATUS AND EXPOSING APPARATUS

CROSS-REFERENCE TO RELATED APPLICATION

This application is based upon and claims the benefit of priority from Japanese Patent Application No. 2014-006607, filed Jan. 17, 2014, the entire contents of which are incorporated herein by reference.

FIELD

Embodiments described herein relate generally to an image forming apparatus, such as an electrophotographic copy machine, and particularly to an image forming apparatus and an exposing apparatus that provide uniform density of an image by correcting the intensity of light of a light scan head (LED head) to compensate for non-uniform density of the image in a main-scanning direction.

BACKGROUND

An image forming apparatus of the related art may employ a light-emitting diode (LED) head. The LED head includes a plurality of LED elements disposed in a main-scanning direction of the LED head. A plurality of LED heads can be disposed in an image forming apparatus for recording images of cyan (C), magenta (M), yellow (Y), and black (K) colors.

When the image forming apparatus prints an image on a sheet, image density may be non-uniform in the main scanning direction, thus posing a problem of deteriorating image quality. The non-uniform image density in the main-scanning direction is mainly caused by variations in mechanical accuracy of the position of a photoreceptor drum and a development roller (e.g., magnetic roller). The variations cause an interval (gap) between the photoreceptor drum and the development roller to be different in the longitudinal direction of the photoreceptor drum and the development roller, thus widening the gap at a central part in the longitudinal direction. In addition, non-uniform image density can also be caused by the photoreceptor drum and the LED head being dislocated in the longitudinal direction.

A regulation member that faces the development roller and regulates the thickness of a layer of a developer is disposed at a predetermined interval with respect to the development roller. The regulation member regulates the layer of the developer on the outer surface of the development roller so that the developer layer does not become excessively thick. However, the image density becomes non-uniform when the development roller bends to decrease the amount of the developer that adheres to the central part of the development roller in the longitudinal direction. In addition, the regulation member bends to change the amount of the developer transported on the development roller, thus causing the non-uniform image density.

Techniques to compensate for the non-uniform image density include improving accuracy and rigidity of components in a part where the gap is formed between the photoreceptor drum and the development roller, or adjusting magnetic power of the development roller in the longitudinal direction. However, these techniques increase cost.

Another technique involves controlling the intensity of light emitted from the LED to correct the non-uniform image density. For example, an image is read, analyzed, and is computationally processed to give feedback to each LED element for correcting change in the intensity of light emitted from the LED element due to temperature change. However, such a technique increases circuit complexity and cost.

DETAILED DESCRIPTION

Embodiments provide an image forming apparatus that controls the intensity of light emitted from each LED element to correct non-uniform image density in a main-scanning direction due to change in the amount of a developer adhered to a photoreceptor drum.

In general, according to one embodiment, there is provided an image forming apparatus including a light scan head that includes a plurality of LED elements which are disposed along a main-scanning direction of a photoreceptor drum and configured to expose the photoreceptor drum with light, a developing device that is disposed to face the photoreceptor drum in the main-scanning direction and includes a development roller configured to supply a developer to the photoreceptor drum, and a non-uniform density correction unit configured to control an intensity of the light emitted from the plurality of LED elements of the light scan head based on correction data that corresponds to a tendency pattern of an expected non-uniform image density of an image that is to be formed on a recording medium caused by change in an adhesion amount of the developer which is supplied to the photoreceptor drum from the developing device when transferring a toner image on the photoreceptor drum to the recording medium.

Hereinafter, exemplary embodiments will be described with reference to the accompanying drawings. The same place in each drawing will be given the same reference sign.

First Embodiment

Figure 1:
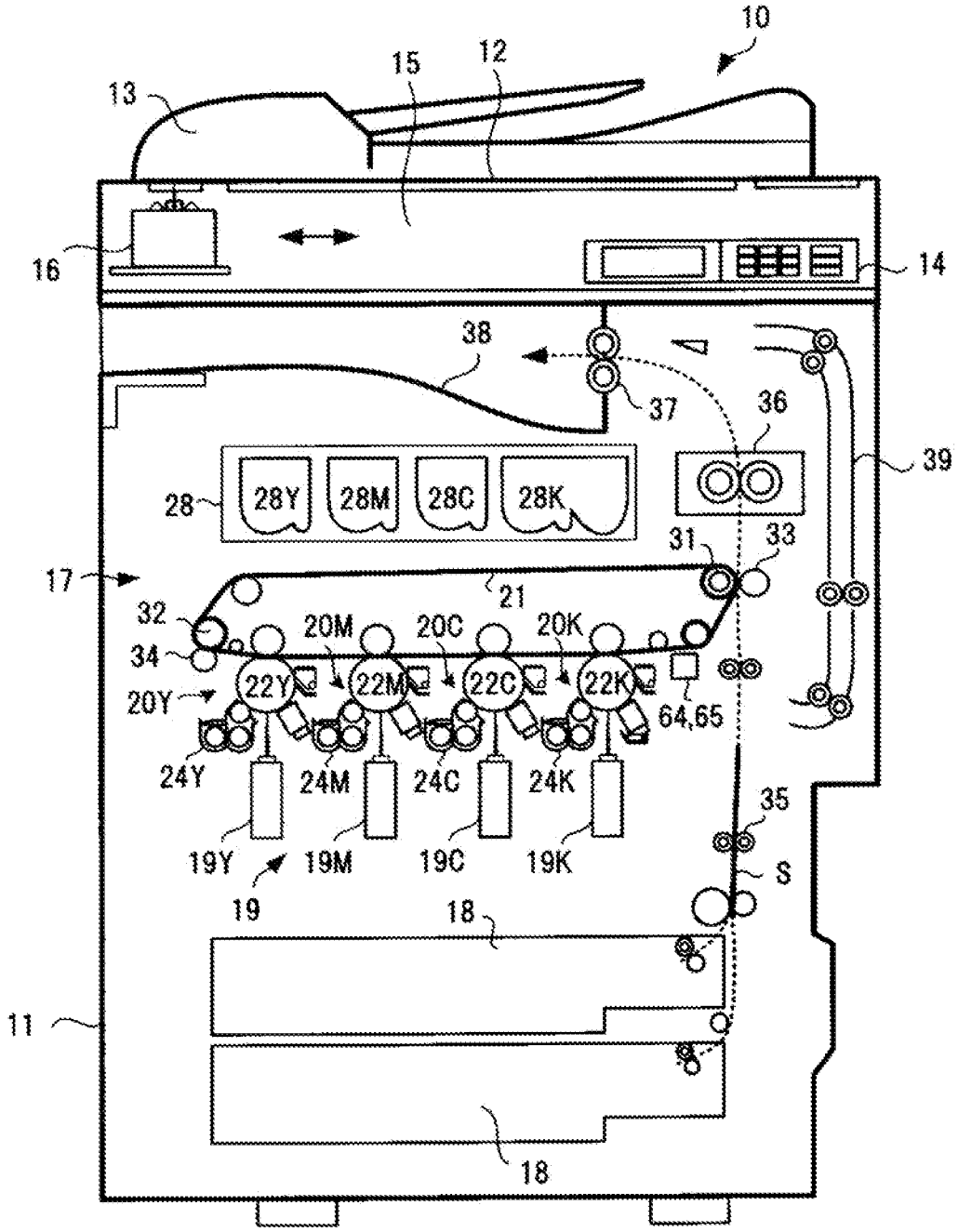
FIG. 1 is a configuration diagram illustrating an image forming apparatus according to a first embodiment.

FIG. 1 is a configuration diagram of an image forming apparatus according to a first embodiment. An image forming apparatus 10, for example, is a multi-function peripheral (MFP) that is a multi-function machine, a printer, a copy machine, or the like in FIG. 1. An MFP will be exemplified in the following description.

A transparent glass document table 12 is in an upper portion of a main body 11 of the MFP 10. An automatic document feeder (ADF) 13 is disposed to be opened and closed over the document table 12. In addition, an operation panel 14 is disposed in the upper portion of the main body 11. The operation panel 14 includes a touch panel-type display unit and various operation keys.

A scanner unit 15 that is a reading device is disposed under the ADF 13 inside the main body 11. The scanner unit 15 reads a document that is transported by the ADF 13 or a document that is placed on the document table to generate image data and includes an image sensor 16. The image sensor 16 is disposed in a main-scanning direction (depth direction in FIG. 1.

When reading an image on a document placed on the document table 12, the image sensor 16 reads the image on the document by one line while moving along the document table 12. The image sensor 16 performs the above read operation along the entire size of the document to read one page of the document. When reading an image on a document transported by the ADF 13, the image sensor 16 is fixed at a position (the position illustrated in FIG. 1.).

A printer unit 17 is provided in a central portion of the main body 11, and a plurality of cassettes 18 that accommodate sheets of various sizes are provided in a lower portion of the main body 11. The printer unit 17 includes a photoreceptor drum and a light scan head that is disposed along the main-scanning direction of the photoreceptor drum. The light scan head includes a plurality of LED elements that are light-emitting elements. The light scan head scans and exposes the photoreceptor drum with rays of light from each LED element.

The printer unit 17 processes image data read in the scanner unit 15 or image data created in a personal computer (PC) and the like to form an image on a sheet that is a recording medium. The printer unit 17, for example, is a color laser printer that uses a tandem system and includes image formation units 20Y, 20M, 20C, and 20K respectively corresponding to yellow (Y), magenta (M), cyan (C), and black (K) colors.

The image formation units 20Y, 20M, 20C, and 20K are disposed parallel to each other on the lower side of an intermediate transfer belt 21 from the upstream side to the downstream side. In addition, a light scan head 19 includes a plurality of light scan heads 19Y, 19M, 19C, and 19K corresponding to the image formation units 20Y, 20M, 20C, and 20K.

Figure 2:
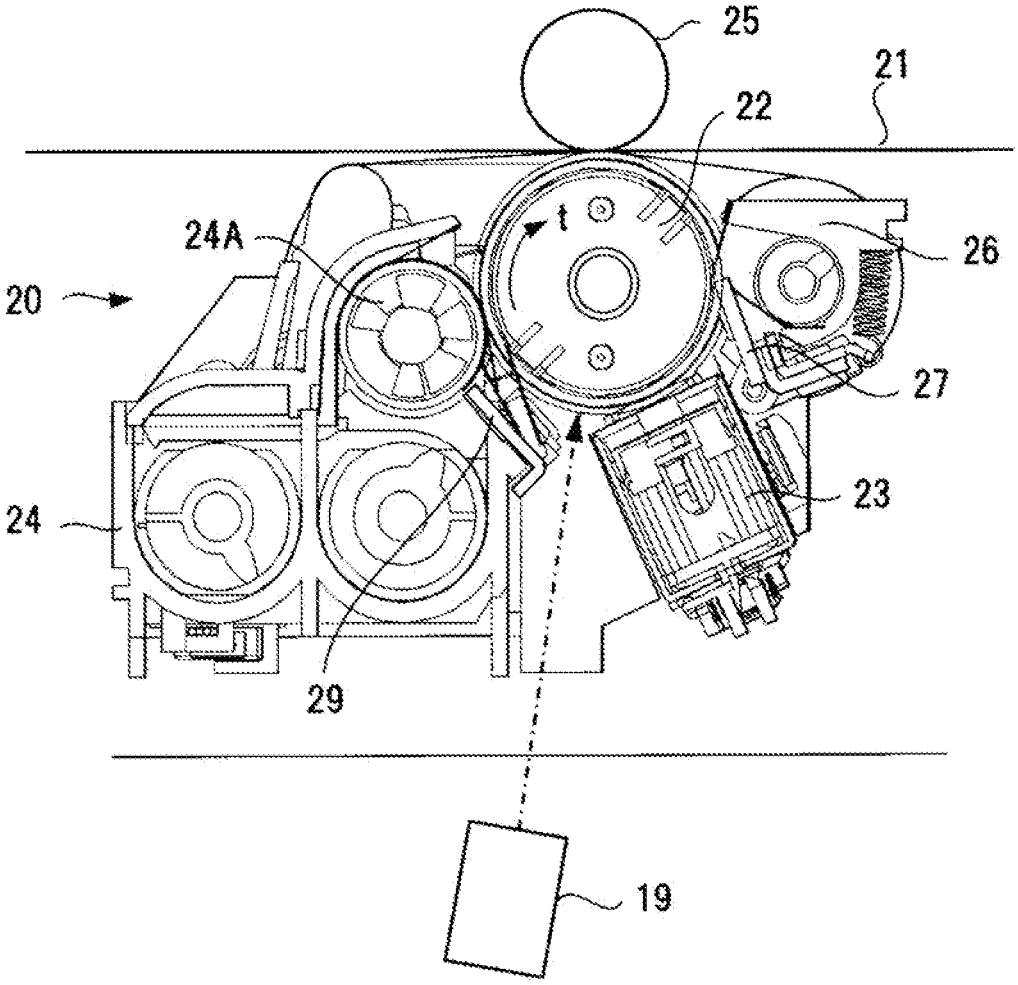
FIG. 2 is a configuration diagram illustrating one enlarged image formation unit in the first embodiment.

FIG. 2 is a configuration diagram illustrating one of the enlarged image formation units 20Y, 20M, 20C, and 20K. Each of the image formation units 20Y, 20M, 20C, and 20K has the same configuration and thus will be described as an image formation unit 20 without the reference signs K, M, C, and K.

An electrifying charger 23, a developing device 24, a primary transfer roller 25, a cleaner 26, a blade 27, and the like are disposed around the photoreceptor drum 22 along a direction of rotation t. An exposed position on the photoreceptor drum 22 is illuminated with light from the light scan head 19, and a latent image is formed on the photoreceptor drum 22.

The electrifying charger 23 uniformly electrifies the entire outer surface of the photoreceptor drum 22 at substantially −700 V, for example. The developing device 24 supplies a two-component developer formed of a toner and a carrier for each color to the photoreceptor drum 22 using a development roller 24A to which a development bias of substantially −500 V is applied, and develops the latent image on the photoreceptor drum 22 to form a toner image on the photoreceptor drum 22. The development roller 24A includes a plurality of fixed magnets and a sleeve that is supported to be rotatable around the outer circumference of the magnets and is also referred to as a magnet roller. The cleaner 26 uses the blade 27 to remove a toner that remains on the outer surface of the photoreceptor drum 22.

A regulation member 29 that regulates the thickness of a layer of the developer is disposed to face the development roller 24A. The regulation member 29 extends parallel to the direction of the axis of the development roller 24A and is disposed at a predetermined interval with respect to the outer surface of the development roller 24A. The regulation member 29 regulates the layer of the developer on the outer surface of the development roller 24A to prevent the layer of developer from becoming excessively thick.

As illustrated in FIG. 1, a toner cartridge 28 is disposed above the image formation units 20Y to 20K to supply a toner to the developing device 24. The toner cartridge 28 includes toner cartridges (28Y to 28K) of respective yellow (Y), magenta (M), cyan (C), and black (K) colors.

The intermediate transfer belt 21 is stretched over a drive roller 31 and a passive roller 32 and moves in a circulating manner. In addition, the intermediate transfer belt 21 is facing and in contact with photoreceptor drums 22Y to 22K. A primary transfer voltage is applied to a position of the intermediate transfer belt 21 that faces the photoreceptor drum 22 by the primary transfer roller 25, and the toner image on the photoreceptor drum 22 is primarily transferred to the intermediate transfer belt 21.

A secondary transfer roller 33 is disposed to face the drive roller 31 that stretches the intermediate transfer belt 21. A secondary transfer voltage is applied to a sheet S by the secondary transfer roller 33 when the sheet S passes between the drive roller 31 and the secondary transfer roller 33. Then, the toner image on the intermediate transfer belt 21 is secondarily transferred to the sheet S. A belt cleaner 34 is disposed in the vicinity of the passive roller 32 and the intermediate transfer belt 21.

A transport roller 35 is disposed between the cassette 18 and the secondary transfer roller 33 to transport the sheet S that is drawn out of the cassette 18 as illustrated in FIG. 1. A fixing device 36 is disposed downstream of the secondary transfer roller 33. A transport roller 37 is disposed downstream of the fixing device 36. The transport roller 37 discharges the sheet S to a sheet discharge unit 38. An inversion transport path 39 is disposed downstream of the fixing device 36. The inversion transport path 39 inverts the sheet S to guide the sheet S to the secondary transfer roller 33 and is used when performing a duplex printing.

Figure 3:
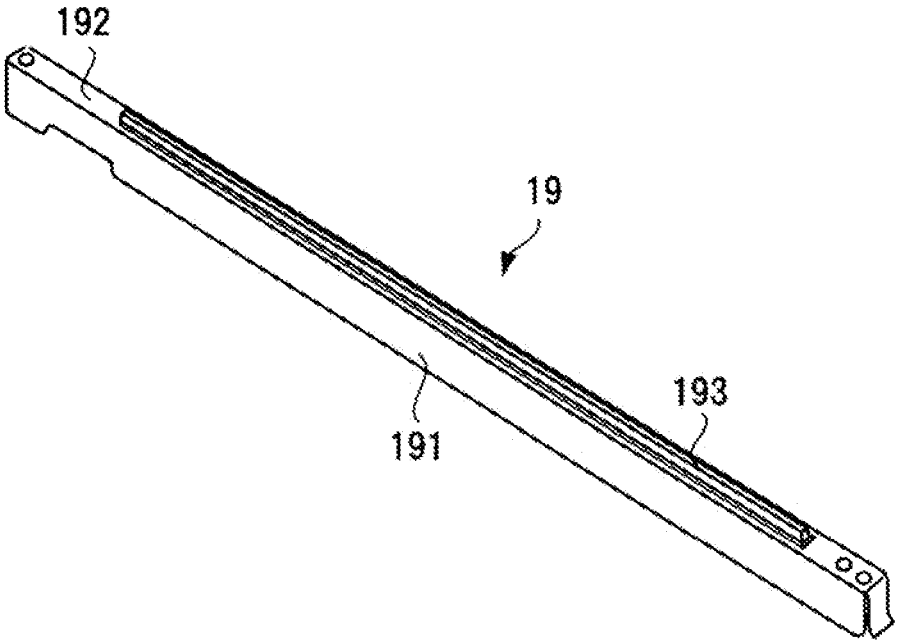
FIG. 3 is a perspective diagram illustrating an LED head in the first embodiment.

FIG. 3 is a perspective diagram illustrating the LED head 19 that is the light scan head. The LED head 19 includes a main body 191 and a cover 192 that covers the main body 191. A light condenser lens array 193 is disposed on the cover 192. A plurality of LED elements 194 (FIG. 7) that are recording elements are disposed linearly along the main-scanning direction in the main body 191. Light emitted from each LED element 194 is condensed in the light condenser lens array 193 and is emitted therefrom. The LED head 19 is provided for each of yellow (Y), magenta (M), cyan (C), and black (K) colors (denoted by 19Y, 19M, 19C, and 19K) in the MFP 10.

Without compensation, image density can become non-uniform in the main-scanning direction when the printer unit 17 prints an image on the sheet S. The non-uniform image density in the main-scanning direction is caused by variations in mechanical accuracy of the position of the photoreceptor drum 22 and the development roller 24A. The variations cause an interval (gap) between the photoreceptor drum 22 and the development roller 24A to vary along the longitudinal direction of the photoreceptor drum 22 and the development roller 24A, thus widening the gap, for example, at a central portion in the longitudinal direction.

Figure 4:
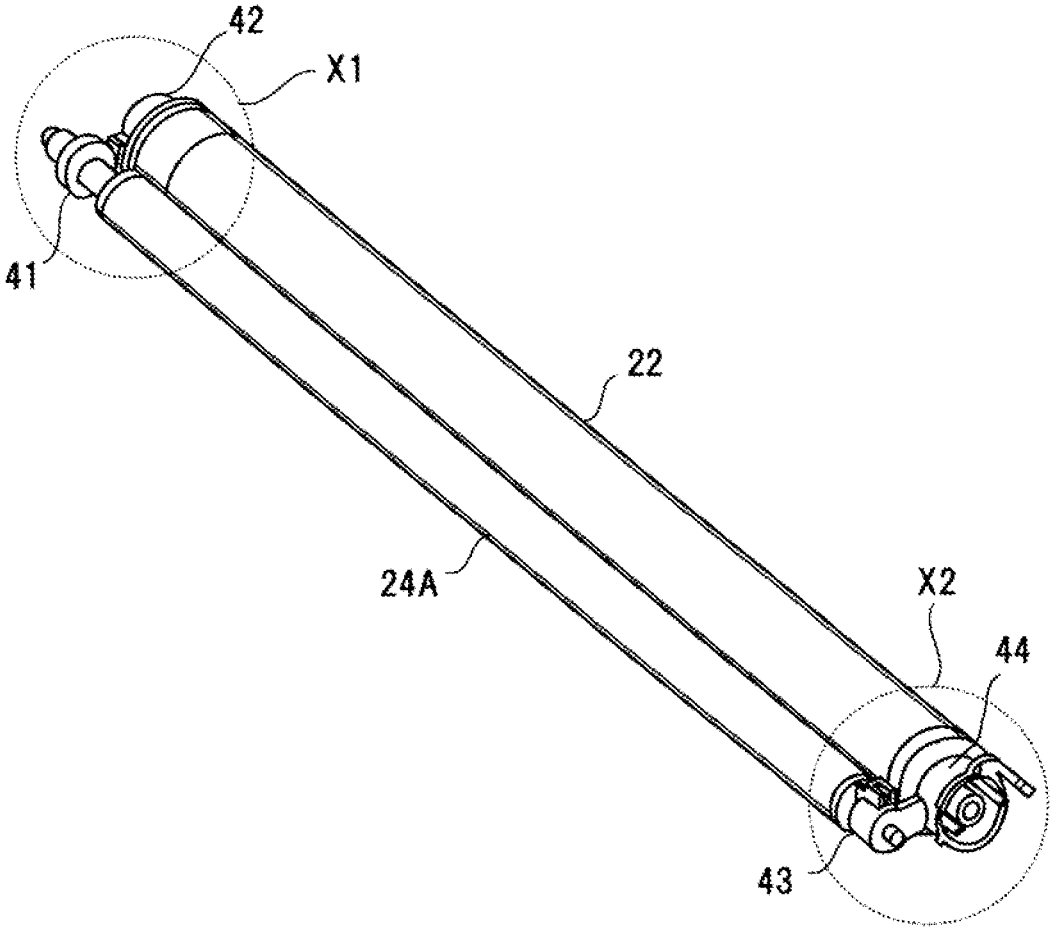
FIG. 4 is a perspective diagram illustrating a photoreceptor drum and a development roller in the first embodiment.

FIG. 4 is a perspective diagram illustrating the photoreceptor drum 22 and the development roller 24A. The photoreceptor drum 22 and the development roller 24A face each other and extend parallel to the main-scanning direction as illustrated in FIG. 4. Regarding one end portion X1, a bearing 41 is provided at one end of the development roller 24A and is pressed to the side of the photoreceptor drum 22. One end portion of the photoreceptor drum 22 that faces the bearing 41 includes a molded component 42.

Regarding the other end portion X2, a molded component 43 is provided at the other end of the development roller 24A and is pressed to the side of the photoreceptor drum 22. The other end portion of the photoreceptor drum 22 that faces the molded component 43 includes a molded component 44.

Figure 5A:
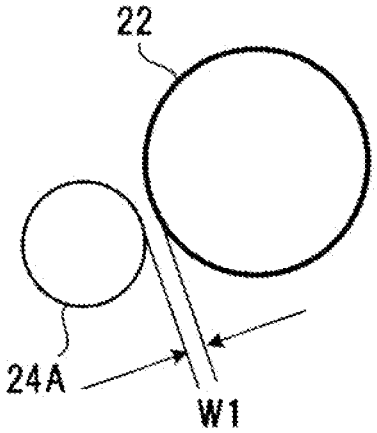
FIGS. 5A and 5B are diagrams illustrating a gap between the photoreceptor drum and the development roller and non-uniform image density of an image due to change in the width of the gap in the first embodiment.

FIG. 5A is a diagram illustrating the gap between the photoreceptor drum 22 and the development roller 24A. A gap width W1 is originally designed to be constant. The gap width may become non-constant as a result of the components in one end portion X1 and the other end portion X2 that form the gap being different from each other. For example, the gap width can be 40 μm in one end portion X1 and can be 35 μm in the other end portion X2. In addition, the gap width between the photoreceptor drum and the development roller tends to be widened at the central part between both end portions in the longitudinal direction (main-scanning direction).

Figure 5B:
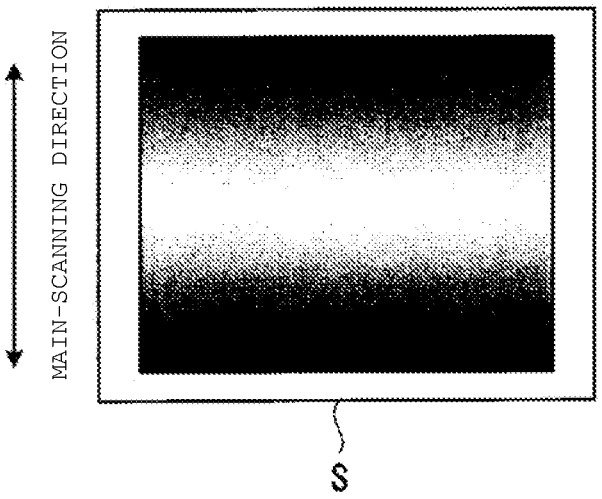

Image density becomes non-uniform as illustrated in FIG. 5B when the gap is widened in the central portion in the main-scanning direction, causing the amount of the developer that adheres to the photoreceptor drum 22 to be decreased in the central portion. FIG. 5B illustrates a slightly exaggerated example of non-uniform image density when printing an image of a middle tone (gray color) on the entire sheet S. Density in the central portion is decreased (e.g., the image becomes lighter) when the gap width is widened in the central portion in the main-scanning direction.

The non-uniformity of the image density may change depending on variation in the gap width. For example, density may be sparse in one end portion and dense in the other portion in the main-scanning direction, or conversely, density may be dense in one end portion and sparse in the other portion in the main-scanning direction.

In addition, image density may be non-uniform due to change in the amount of the developer transported on the development roller 24A as the developer bends though the regulation member 29 that is disposed to face the development roller 24A to regulate the thickness of the layer of the developer, as illustrated in FIG. 2.

In an embodiment, the non-uniform image density is corrected by adjusting the intensity of light emitted from the LED element of the LED head 19. That is, the gap width W1 that is a cause of the non-uniform image density is substantially stabilized depending on accuracy and rigidity of components (bending of the development roller 24A and the like). Accordingly, tendencies of the non-uniform image density (tendency patterns) can be determined for each product. Thus, the intensity of light and a drive time of LEDs are corrected prior to factory shipping to correct difference in the density of an image, thereby correcting non-uniform image density of an image.

Figure 6:
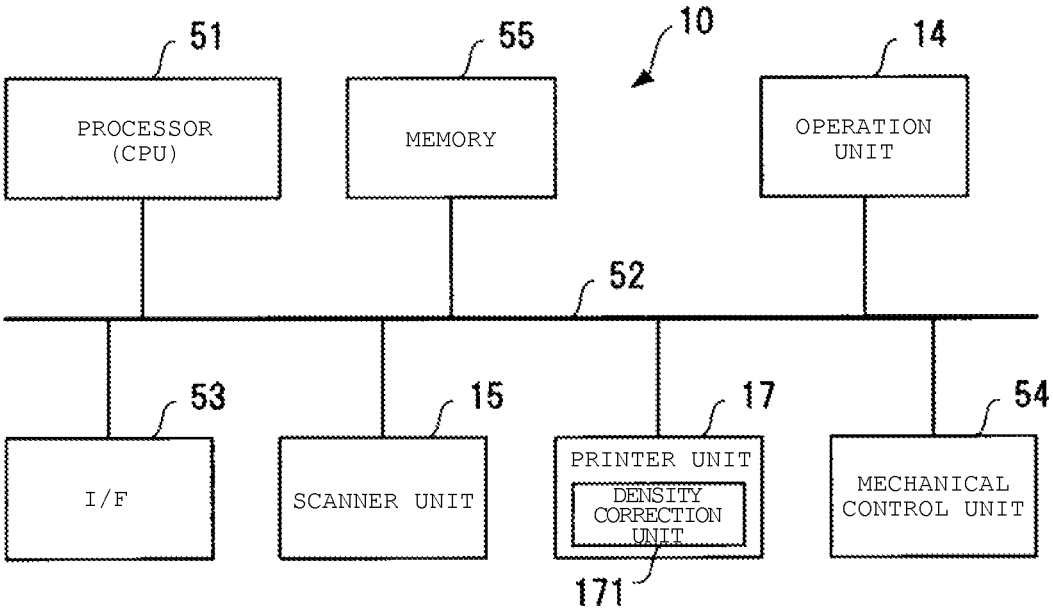
FIG. 6 is a systematic configuration diagram illustrating the image forming apparatus in the first embodiment.

Hereinafter, correction of non-uniform image density will be described. FIG. 6 is a systematic configuration diagram illustrating the image forming apparatus 10 (for example, the MFP) that uses the LED head 19. The MFP 10 includes a processor 51 that is a control unit. The processor 51 is connected to a communication interface (I/F) 53, the scanner unit 15, the printer unit 17, a mechanical control unit 54 that controls a mechanical mechanism unit, the operation unit 14 that includes a display unit, a memory 55, and the like through a bus line 52.

The processor 51 is a computer that includes a CPU, performs predetermined processes based on an image process program stored in the memory 55, and controls operations related to image formation. The memory 55, for example, includes a random access memory (RAM), a read-only memory (ROM), a dynamic random access memory (DRAM), a static random access memory (SRAM), a video RAM (VRAM), or the like. Various information and programs used in the MFP 10 are stored in the memory 55.

The communication interface (I/F) 53 communicates with external devices, such as a personal computer (PC) and the like. The operation unit 14, for example, includes a touch panel-type display unit and various operation keys. A user or a serviceman may input various instructions in the operation unit 14. The scanner unit 15 reads a document that is transported by the ADF 13 or a document that is placed on the document table to generate image data. The printer unit 17 forms an image on the sheet S and includes the image formation units (20Y, 20M, 20C, and 20K) and the LED heads (19Y, 19M, 19C, and 19K) described above. The printer unit 17 further includes a density correction unit 171.

Figure 7:
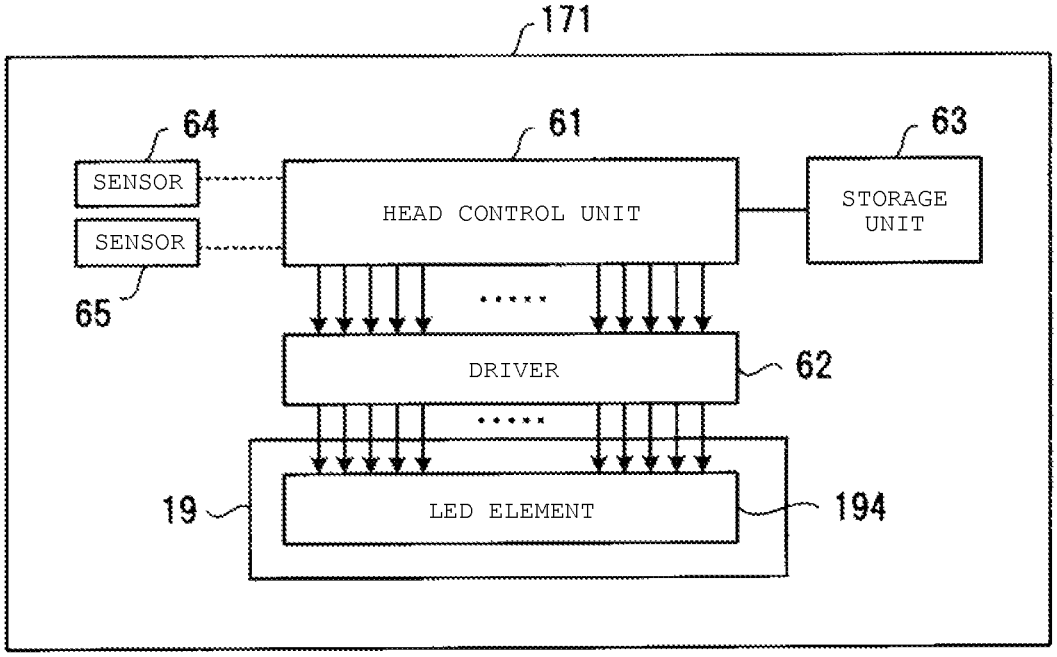
FIG. 7 is a block diagram illustrating the configuration of a density correction unit in the first embodiment.

FIG. 7 is a block diagram illustrating the configuration of the density correction unit 171. The density correction unit 171 includes a head control unit 61 that controls the LED head 19, a driver 62 that drives each LED element 194 of the LED head 19, and a storage unit 63. The LED elements 194 are aligned along the main-scanning direction and are disposed to correspond to each pixel when forming an image.

The head control unit 61 supplies a drive signal that corresponds to the image data to the driver 62. The driver 62 supplies a current for each pixel to the corresponding LED element 194. The current (intensity of emitted light) to the LED element 194 is adjusted by the drive signal supplied to the driver 62 from the head control unit 61. Thus, the intensity of light with which the photoreceptor drum 22 is exposed may be changed.

Correction data for correcting the intensity of light emitted from the LED element 194 is stored in the storage unit 63. For example, correction data for increasing the intensity of light of the LED element in the central portion of the LED element 194 in the main-scanning direction is stored in the storage unit 63 for a tendency pattern in which the gap width between the development roller 24A and the photoreceptor drum 22 is widened in the central portion in the main-scanning direction, and image density becomes sparse in the central portion of the sheet S in the main-scanning direction as illustrated in FIG. 5B. In other examples, correction data can be stored for other tendency patterns having non-uniform image density in various forms when forming an image on the sheet S.

The head control unit 61 reads correction data from the storage unit 63 and supplies a correction signal for correcting density to the driver 62 when supplying a current for each pixel to the LED element 194. Besides changing a current that flows in the LED element, a drive time of the LED element may be changed to adjust the intensity of light emitted from the LED element 194.

Figure 8:
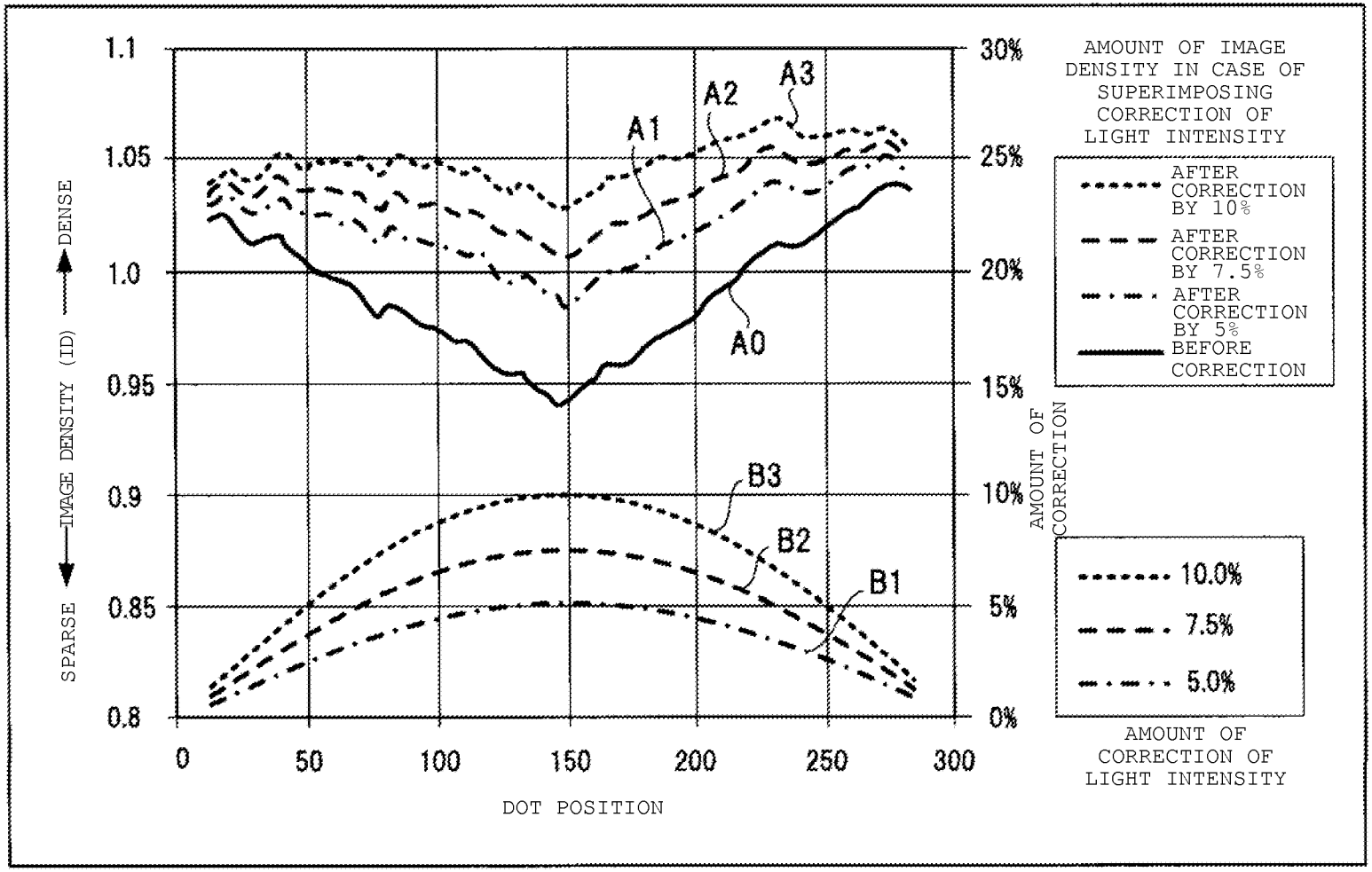
FIG. 8 is a characteristic diagram illustrating correction of the intensity of light of the LED element in the first embodiment.

FIG. 8 is a characteristic diagram illustrating correction of the intensity of light of the LED element. That is, FIG. 8 is a diagram illustrating an example of the amount of correction of image density and the intensity of light of the LED element by the density correction unit 171. The vertical axis (left) in FIG. 8 illustrates image density, and the vertical axis (right) illustrates the amount of correction (%). The horizontal axis illustrates a dot position of the LED element 194 in the main-scanning direction.

A characteristic graph A0 in an upper portion of FIG. 8 illustrates non-uniform image density in which the gap width between the development roller 24A and the photoreceptor drum 22 is widened in the central portion in the main-scanning direction, and image density becomes sparse in the central portion of the sheet S in the main-scanning direction.

Characteristic graphs B1 to B3 in a lower portion of FIG. 8 illustrate correction data for the non-uniform image density A0. For example, the correction data B1 illustrates an example in which the intensity of light emitted from the LED element that corresponds to the dot position at the central part is corrected (increased) by 5%, and the intensity of light emitted from the LED element that corresponds to the dot position in the end portion is barely corrected.

When the non-uniform image density is corrected based on the correction data B1, image density in the central portion in the main-scanning direction in the characteristic graph A0 becomes slightly more dense, as illustrated in a characteristic graph A1. The correction data B2 is for correcting (increasing) the intensity of light emitted from the LED element by 7.5%. When the non-uniform image density is corrected based on the correction data B2, image density in the central portion in the main-scanning direction becomes still more dense, as illustrated in a characteristic graph A2. The correction data B3 is for correcting (increasing) the intensity of light emitted from the LED element by 10%. When the non-uniform image density is corrected based on the correction data B3, image density in the central portion in the main-scanning direction becomes still more dense as illustrated in a characteristic graph A3.

That is, the density correction unit 171 controls the intensity of light emitted from the plurality of LED elements 194 of the LED head 19 based on the correction data with respect to characteristics and reverse characteristics of the non-uniform image density. Accordingly, reading correction data that corresponds to a tendency pattern of non-uniform image density from the storage unit 63 and correcting the intensity of light emitted from the LED element 194 based on the correction data may correct image density of an image to be printed. Non-uniform image density may be corrected by allowing a user to finely adjust the amount of correction when it is difficult to sufficiently correct the non-uniform image density with correction data.

Figure 9:
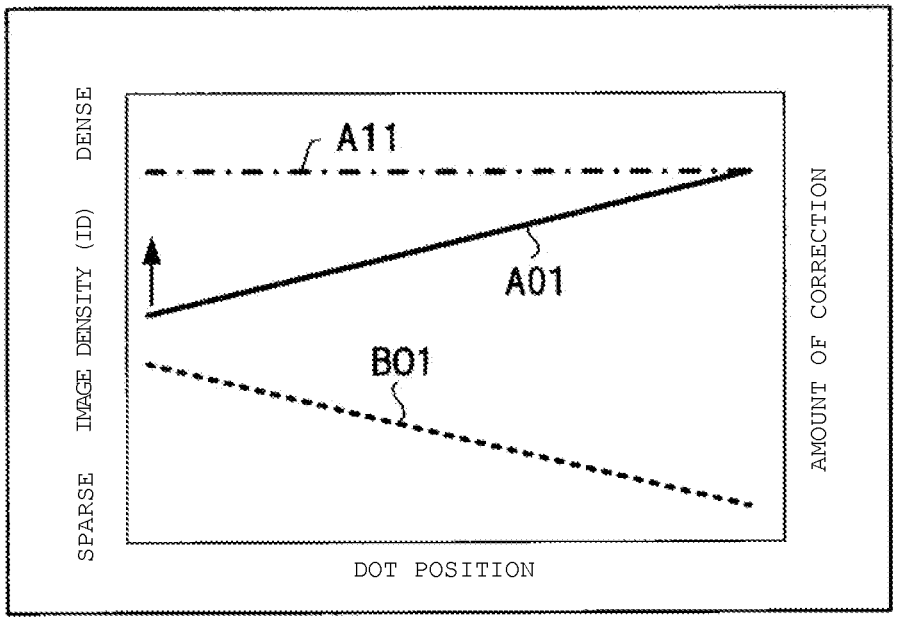
FIG. 9 is another characteristic diagram illustrating correction of the intensity of light of the LED element in the first embodiment.

FIG. 9 is a characteristic diagram illustrating correction of the intensity of light of the LED element and illustrates another tendency pattern. A characteristic graph A01 in an upper portion of FIG. 9 illustrates an example in which image density becomes dense linearly from one end portion to the other end portion in the main-scanning direction. Correction data B01 in FIG. 9 is used for the tendency pattern A01. With the correction data B01, correction is made in such a manner that the intensity of light emitted from the LED element that corresponds to the dot position in one end portion in the main-scanning direction is increased, and the intensity of light emitted from the LED element 194 that corresponds to the dot position in the other end portion is decreased. Accordingly, the non-uniform image density may be corrected as illustrated in a characteristic graph A11.

Figure 10:
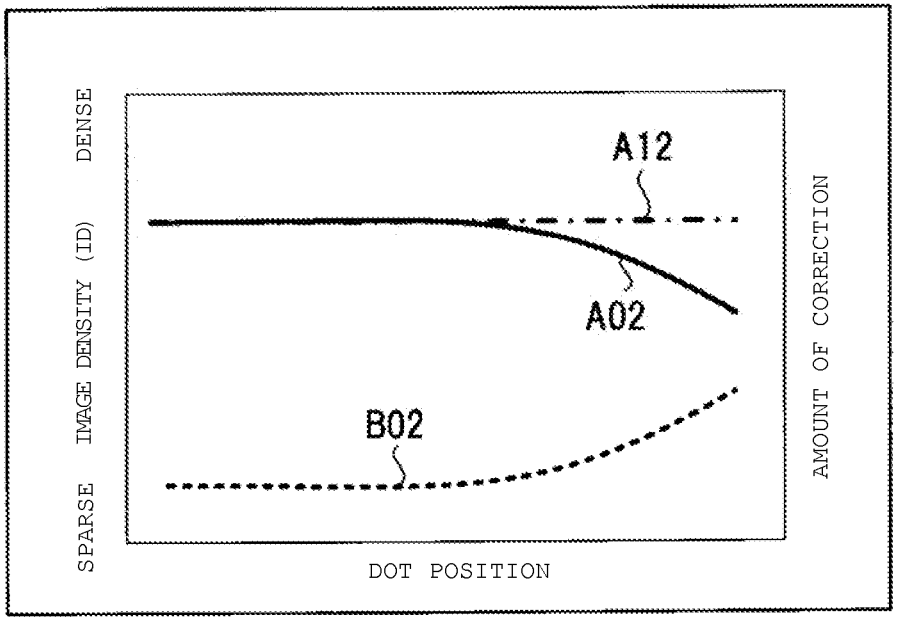
FIG. 10 is still another characteristic diagram illustrating correction of the intensity of light of the LED element in the first embodiment.

FIG. 10 is a characteristic diagram illustrating correction of the intensity of light of the LED element and illustrates still another tendency pattern. A characteristic graph A02 in an upper portion of FIG. 10 illustrates an example in which image density is substantially uniform from one end portion to the central portion in the main-scanning direction but becomes sparse from the central portion to the other end portion. Correction data B02 in FIG. 10 is used for the tendency pattern A02. With the correction data B02, correction is made in such a manner that the intensity of light emitted from the LED element that corresponds to the dot position from one end portion to the central portion in the main-scanning direction is constant, and the intensity of light emitted from the LED element 194 that corresponds to the dot position from the central portion to the other end portion is gradually increased. Accordingly, the non-uniform image density may be corrected as illustrated in a characteristic graph A12.

When the intensity of light or a characteristic of light emission of the individual LED element 194 varies in recording an image using the LED head 19, image density may be non-uniform, or irregular streaking may occur, in a direction orthogonal to the direction in which the LED head 19 is aligned (main-scanning direction). For this reason, generally, the intensity of light emitted from each LED element is individually detected, and a corresponding duty cycle of light emitted from the LED element is changed according to each detected value to correct the intensity of emitted light. In this case, the head control unit 61 superimposes correction data for correcting non-uniform image density caused by change in the amount of the transported developer described above on correction data for correcting variations in the individual LED element to control the intensity of light emitted from each LED element.

In the embodiment described above, the intensity of light emitted from the LED element may be corrected based on correction data for tendency patterns, and thus, non-uniform image density may be corrected even when image density becomes non-uniform in the main-scanning direction because of the amount of the developer that adheres to the photoreceptor drum 22 being changed due to the gap width between the photoreceptor drum 22 and the development roller 24A or due to bending of the development roller 24A or the regulation member 29.

Second Embodiment

Figure 11:
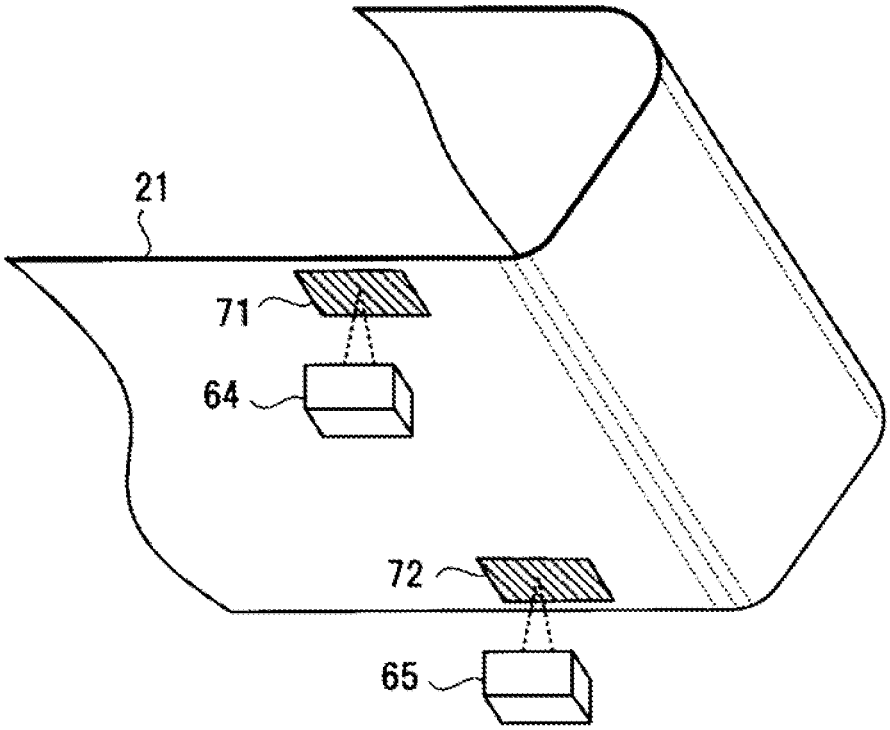
FIG. 11 is a configuration diagram illustrating the disposition of a sensor in a second embodiment.

FIG. 11 is a configuration diagram related to a second embodiment. In the second embodiment, inspection images 71 and 72 for correction are printed on both sides (the front side and the rear side) of the transfer belt 21. The inspection images 71 and 72 are respectively detected by sensors 64 and 65, and the detection result is supplied to the head control unit 61. The inspection images 71 and 72 are printed outside an image formation area of the sheet S (on an end portion of the belt). As the sensors 64 and 65, for example, CCD sensors or CMOS sensors used in digital cameras are used.

Image densities of the inspection images 71 and 72 printed on the transfer belt 21, for example, differ from each other in the case of the tendency pattern A01 illustrated in FIG. 9. The sensors 64 and 65 detect the inspection images 71 and 72 and supply the detection result to the head control unit 61. The head control unit 61 calculates the difference of the image densities from the detection result of the sensors 64 and 65 and drives the LED element 194 so that the densities of the inspection images 71 and 72 are substantially equalized.

For example, in the case of the tendency pattern A01 illustrated in FIG. 9, since the image densities detected by each of the sensors 64 and 65 differ from each other, correction is made in such a manner that the intensity of light emitted from the LED element that corresponds to the dot position in one end portion (left) in the main-scanning direction is increased by an amount of the difference thereof from the intensity of light emitted from the LED element 194 that corresponds to the dot position in the other end portion (right), and the intensity of light emitted from the LED element 194 in the central portion is increased by half the amount of the difference. Accordingly, the non-uniform image density may be corrected as illustrated in the characteristic graph A11.

According to the second embodiment, non-uniform image density on the front side and the rear side of the transfer belt 21 may be corrected by detecting the inspection images 71 and 72 with the sensors 64 and 65 installed on the front side and the rear side of the transfer belt 21 even when tendency patterns are changed due to variations in components or an installed state of the MFP 10.

According to the embodiments described above, non-uniform image density may be corrected by correcting the intensity of light emitted from the LED element even when image density becomes non-uniform in the main-scanning direction. Such non-uniformity in image density can result when the amount of the transported developer varies due to variations in the gap between the photoreceptor drum 22 and the development roller 24A or the regulation member 29 in addition to variations in the characteristic of light emission of the LED element.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a light scan head including a plurality of LED elements, disposed along a main-scanning direction of a photoreceptor drum, configured to expose the photoreceptor drum with light;

a developing device, disposed to face the photoreceptor drum in the main-scanning direction, including a development roller configured to supply a developer to the photoreceptor drum;

a transfer belt configured to transfer the toner image on the photoreceptor drum to a recording medium; and a non-uniform density correction unit configured to control an intensity of the light emitted from the plurality of LED elements of the light scan head based on correction data, the correction data corresponding to a tendency pattern of an expected non-uniform image density of an image that is to be formed on the recording medium caused by change in an adhesion amount of the developer which is supplied to the photoreceptor drum from the developing device when transferring a toner image on the photoreceptor drum to the recording medium, the non-uniform density correction unit including:

first and second sensors configured to respectively detect a first inspection image and a second inspection image that are printed on both sides of the transfer belt outside an image formation area of the transfer belt; and a control unit configured to calculate a difference in image densities of the first and second inspection images as detected by the first and second sensors, and control the intensity of light emitted from the plurality of LED elements based on the difference in the image densities.

2. The apparatus according to claim 1, wherein the non-uniform density correction unit stores correction data that corresponds to a plurality of tendency patterns of non-uniform image density of an image formed on a recording medium in a storage unit, and controls intensity of light emitted from the plurality of LED elements based on the correction data that is read from the storage unit.

3. The apparatus according to claim 1, wherein the control unit is configured to control the intensity of light emitted from the plurality of LED elements to substantially equalize the difference in the image densities of the first and second inspection images.

4. The apparatus according to claim 1, wherein the non-uniform image density of the image formed on the recording medium comprises effects of a variation in a gap width between the photoreceptor drum and the development roller along the main-scanning direction.

5. The apparatus of claim 4, wherein the gap width is wider in a central portion along the main-scanning direction than in respective end portions.

6. An exposing apparatus for an image forming apparatus having a developing device disposed to face a photoreceptor drum in a main-scanning direction, the developing device including a development roller configured to supply a developer to the photoreceptor drum, the exposing apparatus, comprising:

a plurality of LED elements which are disposed along the main-scanning direction of the photoreceptor drum and configured to expose the photoreceptor drum with light;

a transfer belt configured to transfer the toner image on the photoreceptor drum to a recording medium; and a non-uniform density correction unit configured to control intensity of the light emitted from the plurality of LED elements based on correction data, the correction data corresponding to a tendency pattern of an expected non-uniform image density of an image that is to be formed on a recording medium caused by change in an adhesion amount of the developer which is supplied to the photoreceptor drum from the developing device when transferring a toner image on the photoreceptor drum to the recording medium, the non-uniform density correction unit including:

first and second sensors configured to respectively detect a first inspection image and a second inspection image that are printed on both sides of the transfer belt outside an image formation area of the transfer belt; and a control unit configured to calculate a difference in image densities of the first and second inspection images as detected by the first and second sensors, and control the intensity of light emitted from the plurality of LED elements based on the difference in the image densities.

7. The apparatus according to claim 6, wherein the non-uniform density correction unit stores correction data that corresponds to a plurality of tendency patterns of non-uniform image density of an image formed on a recording medium in a storage unit, and controls intensity of light emitted from the plurality of LED elements based on the correction data that is read from the storage unit.

8. The apparatus according to claim 6, wherein the control unit is configured to control the intensity of light emitted from the plurality of LED elements to substantially equalize the difference in the image densities of the first and second inspection images.

9. The apparatus according to claim 6, wherein the non-uniform image density of the image formed on the recording medium comprises effects of a variation in a gap width between the photoreceptor drum and the development roller along the main-scanning direction.

10. The apparatus of claim 9, wherein the gap width is wider in a central portion along the main-scanning direction than in respective end portions.

11. A method of operating an image forming apparatus having a developing device disposed to face a photoreceptor drum in a main-scanning direction, the developing device including a development roller configured to supply a developer to the photoreceptor drum, the image forming apparatus further comprising a transfer belt configured to transfer the toner image on the photoreceptor drum to the recording medium, the method comprising:

exposing the photoreceptor drum with light generated by a plurality of LED elements;

controlling the intensity of the light emitted by the plurality of LED elements based on correction data, the correction data corresponding to a tendency pattern of an expected non-uniform image density of an image that is to be formed on a recording medium caused by change in an adhesion amount of the developer which is supplied to the photoreceptor drum from the developing device when transferring a toner image on the photoreceptor drum to the recording medium;

detecting a first inspection image and a second inspective image printed on both sides of the transfer belt outside an image formation area of the transfer belt;

calculating a difference in image densities of the first and second inspection images; and controlling the intensity of the light emitted by the plurality of LED elements to substantially equalize the difference in the image densities.

12. The method of claim 11, wherein a plurality of correction data each corresponding to one of a plurality of tendency patterns of non-uniform image density of an image formed on a recording medium are stored, and the intensity of light emitted from the plurality of LED elements is controlled based on one of the stored correction data.

* * * * *